US005652631A

United States Patent [19]

Bullen et al.

[11] Patent Number: 5,652,631

[45] Date of Patent: Jul. 29, 1997

[54] DUAL FREQUENCY RADOME

[75] Inventors: William E. Bullen, Tucson, Ariz.; Henry T. Killackey, Covina, Calif.; William E. Salmond, Tucson, Ariz.

[73] Assignee: Hughes Missile Systems Company, Los Angeles, Calif.

[21] Appl. No.: 436,897

[22] Filed: May 8, 1995

[51] Int. Cl.[6] ..... H01Q 19/06

[52] U.S. Cl. ..... 343/872; 343/909; 343/753

[58] Field of Search ..... 343/872, 771, 343/909, 700 MS File, 753; H01Q 19/14, 19/06

[56] References Cited

U.S. PATENT DOCUMENTS

| | | | |
|---|---|---|---|
| 3,214,760 | 10/1965 | Yonkers | 343/753 |
| 3,774,224 | 11/1973 | Shibano et al. | 343/872 |
| 3,864,690 | 2/1975 | Pierrot | 343/872 |
| 3,886,561 | 5/1975 | Beyer | 343/910 |
| 3,961,333 | 6/1976 | Purinton | 343/872 |
| 4,070,678 | 1/1978 | Smedes | 343/754 |
| 4,352,108 | 9/1982 | Milne | 343/909 |
| 4,570,166 | 2/1986 | Kuhn et al. | 343/872 |
| 4,684,954 | 8/1987 | Sureau et al. | 343/909 |
| 4,872,019 | 10/1989 | Chow et al. | 343/753 |
| 4,901,086 | 2/1990 | Smith | 343/909 |
| 4,905,014 | 2/1990 | Gonzalez et al. | 343/909 |
| 5,394,163 | 2/1995 | Bullen et al. | 343/771 |

FOREIGN PATENT DOCUMENTS

| | | | |
|---|---|---|---|
| 2281659 | 3/1976 | France | 343/872 |
| 87-189803 | 8/1987 | Japan . | |

*Primary Examiner*—Hoanganh T. Le

*Attorney, Agent, or Firm*—Charles D. Brown; Wanda K. Denson-Low

[57] ABSTRACT

A dual frequency antenna and radome system, including a dual frequency antenna system for operation at a first, higher frequency band and at a second lower frequency band. The antenna system includes a first antenna operable at the first frequency band and a second antenna operable at the second frequency band. The first and second antenna systems are orthogonally polarized. A radome is tuned for dual frequency operation, and includes a dielectric wall having a thickness equal to one-half wavelength at a frequency in the first frequency band. The radome further includes a grid of monopole elements formed on a surface of the dielectric wall orthogonal to the first antenna to tune the radome to efficient operation at the second frequency band.

18 Claims, 5 Drawing Sheets

DUAL FREQUENCY RADOME

TECHNICAL FIELD OF THE INVENTION

The present invention relates to radomes, and more particularly to a high efficiency, dual band radome useful for missile applications.

BACKGROUND OF THE INVENTION

Radomes are used to provide environmental protection for antennas mounted on aircraft and missiles. Typically, the radomes are fabricated of a thickness of a dielectric material, wherein the thickness is one-half wavelength at a mid-band frequency of operation for the antenna. The one-half wavelength thickness is optimal for RF transmittance.

Current high velocity missile radomes are typically designed for a narrow band of radio frequency RF operation. To meet these requirements, radome designs (minimizing losses and boresight errors) are relatively straightforward, in that the construction is typically monolithic and the thickness is on the order of one-half wavelength for the chosen dielectric material.

With the current evolution of multi-band tactical missile systems, the application of standard design techniques does not provide adequate performance through wideband, or multi-band, RF operation. A significant compromise must be made in performance characteristics of non-tuned RF spectrums, using conventional radome designs. Additionally, the continued need to protect the RF seeker from the aerothermal environment necessitates the use of ultra-high-strength ceramic-type materials which do not lend themselves to broadband or multi-band configurations. A new radome concept is needed which will ensure low insertion loss and adequate boresight error slope performance for two or more, non-harmonically related frequency bands.

SUMMARY OF THE INVENTION

This invention is a new approach to a dual band radome suitable for dual-frequency missiles for which the RF energy for the two frequencies is orthogonally polarized. In accordance with one aspect of the invention, a dual frequency radome is described, wherein the radome is tuned for efficient transmittance of radiation at a high frequency band and polarized at a first polarization sense and for efficient transmittance of radiation at a low frequency band and polarized at a second polarization sense which is transverse to the first polarization sense. The radome comprises a dielectric wall having a thickness to tune the radome for efficient operation at the first frequency band, the thickness equal to one-half wavelength at a frequency in the first frequency band. The radome further includes a grid of reflective monopole elements formed on the dielectric wall orthogonally to the first polarization sense to tune the radome for efficient operation at the second frequency band.

In accordance with another aspect of the invention, a dual frequency antenna and radome system is described, comprising a dual frequency antenna system for operation at a first, higher frequency band and at a second lower frequency band. The antenna system includes a first antenna operable at the first frequency band and a second antenna operable at the second frequency band. The first and second antenna systems are orthogonally polarized. The system further includes a radome tuned for dual frequency operation, the radome including a dielectric wall having a thickness to tune the radome for efficient operation at the first frequency band. The thickness is equal to one-half wavelength at a frequency in the first frequency band. The radome further includes a grid of reflective monopole elements formed on a surface of the dielectric wall orthogonal to the first antenna and adapted to tune the radome to efficient operation at the second frequency band.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

A dual band radome is provided by this invention, wherein the radome is tuned to operation at two frequency bands having a non-harmonic relationship. Applications involving non-harmonic frequency bands provide a motivation for this type of dual band radome. Optimum transmission occurs at radome wall thicknesses of one-half wavelength or multiples thereof, with diminishing performance capability with increased number of one-half wavelength thickness. Conversely, worst-case radome performance occurs for multiple one-quarter wavelength thicknesses. If two RF signals were harmonically related, the multiple half-wave relationship could be applied to the radome design. In most cases, however, the two, or more, signals are non-harmonically related, and a radome design which favors one frequency band would most likely yield poor performance for the other band, i.e., a one-half wavelength thickness for one band, but close to a N(half-wavelength) configuration for the second band.

Figure 1:
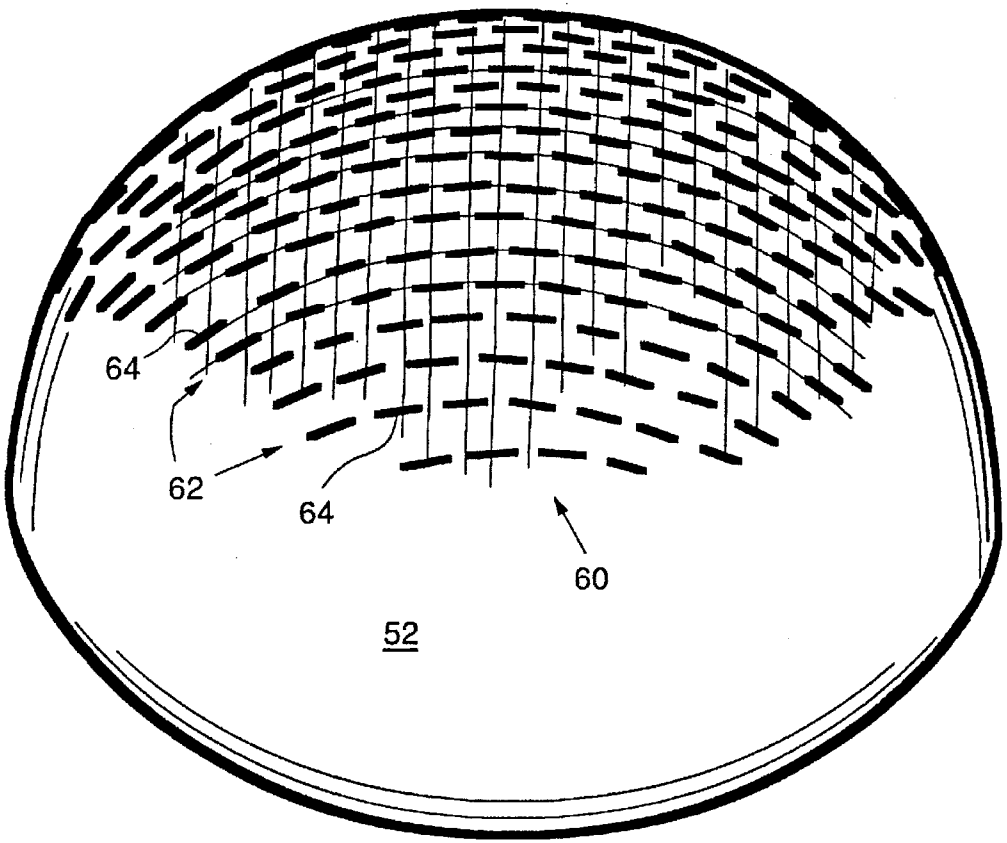
FIG. 1 is an isometric view of a full hemisphere dual band radome with a monopole grid in accordance with the invention.

FIG. 1 illustrates an exemplary embodiment of a dual band radome 50 in a full hemispherical shape useful for a missile application. The dual band radome 50 includes a dielectric wall 52 having a thickness equal to one-half wavelength, tuned at frequency $F_{high}$. To this extent, the radome is conventional. In accordance with the invention, a resonant monopole grid 60 is applied to a surface of the wall 52 to also tune the dielectric sheet for half-wave resonance at an alternate wavelength at frequency $F_{low}$. The monopole grid interacts with the applied RF energy at a particular frequency band; i.e., the grid 60 is resonant at that frequency. The grid 60 includes a plurality of staggered rows 62 of monopole elements 64.

In this exemplary embodiment, the monopole grid 60 is fabricated of reflective dichroic monopole elements 64 applied to a surface of or embedded within the dielectric wall 52. The elements 64 are dichroic in the sense that the wall 52 and grid 60 respond as a resonant reflector for co-polarized RF energy of a specific frequency band, and are nearly invisible to all cross-polarized RF energy.

The radome 50 provides dual band performance when used with two antennas, the first operating at an upper frequency band centered at $F_{high}$, the second operating at a lower frequency band centered at $F_{low}$, and wherein the two antennas are orthogonally polarized.

Figure 2A:
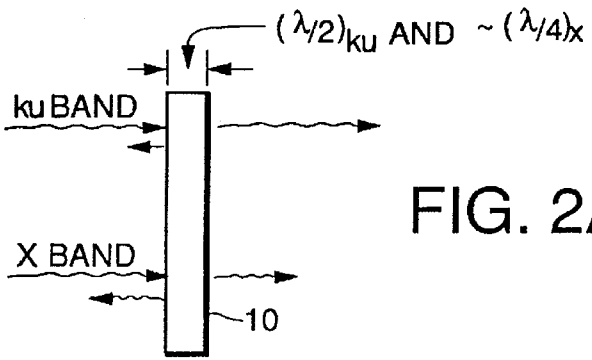
FIG. 2A illustrates the Ku and X band transmittance of a dielectric sheet having a thickness of one-half wavelength at Ku band and one quarter wavelength at X band.
Figure 2B:
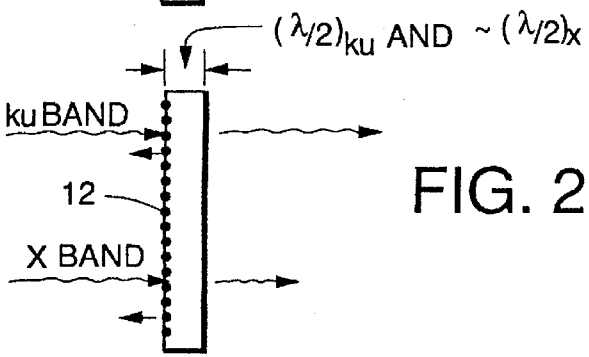
FIG. 2B illustrates the change in transmittance due to the addition of an orthogonal monopole grid to the dielectric sheet of FIG. 2A.
Figure 2C:
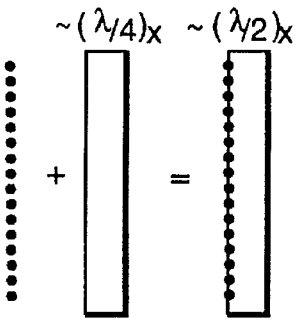
FIG. 2C illustrates in a simplistic fashion the operational principle of the invention.

FIGS. 2A–2C illustrate in a simplistic manner the operational principle of the invention. Sheet 10 is a dielectric layer having a thickness selected to be one-half wavelength at an upper frequency, say in the Ku band, and which is one quarter wavelength at a lower frequency in the X band. Suppose that both Ku band and X band radiation are incident on the dielectric sheet, as shown by the arrows in FIG. 2A, with the X band radiation being orthogonally polarized relative to the Ku band radiation. Since the sheet thickness is one-half the Ku band wavelength, the Ku band radiation will be efficiently transmitted through the dielectric sheet, with only a small component reflected from the sheet. However, the X band radiation is not efficiently transmitted by the dielectric sheet 10, since the thickness is on the order of one quarter wavelength, and a large component of the incident X band radiation is reflected by the dielectric sheet 10.

FIG. 2B shows the case in which an orthogonal monopole grid 12 has been applied to the sheet 10, to be resonant at the X band frequency band. The combination of the monopole grid 12 and the dielectric sheet thickness provides much improved X band transmittance, as shown by the respective lengths of the reflected and transmitted radiation components. The operational principle, simplistically shown in FIG. 2C, is that the orthogonal monopole grid effectively provides a quarter wavelength of additional delay to the one quarter wavelength delay of the dielectric sheet, resulting in an effective sheet/grid electrical thickness of one-half wavelength, which efficiently transmits the X band radiation.

Figure 3:
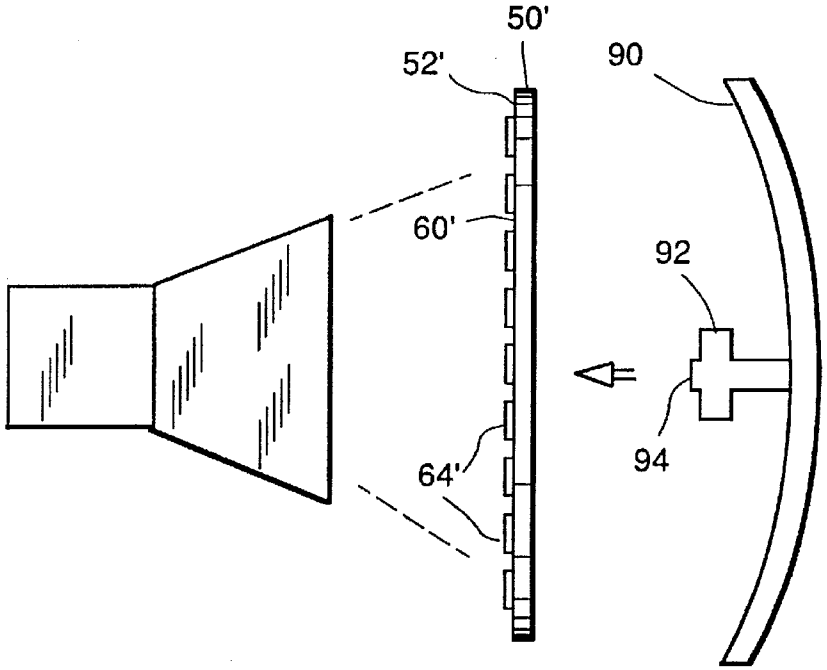
FIG. 3 illustrates a flat radome structure embodying the invention, and a range test configuration for testing the operation of the radome.

To demonstrate this invention, a prototype flat panel radome fabricated of $Al_2O_3$ (alumina) with a resonant monopole grid was range tested with X- and Ku-band radiation. FIG. 3 illustrates the test configuration. The radome panel 50' has applied to a surface 52' a monopole grid 60' comprising the monopole elements 64' which are reflective of RF radiation. The flat panel 50' of alumina material ($\epsilon_R$=8.3) is mechanically tuned to half-wavelength at frequency $F_{high}$, i.e., at the Ku band. The thickness of the panel is one-half wavelength at $F_{high}$. A transmit antenna 90 includes a first antenna 92 for operation at $F_{high}$, and a second antenna 94 for operation at $F_{low}$. The antennas 92 and 94 are orthogonally positioned relative to each other. Conventional gain horns (not shown) are used on receive for both the X- and Ku-band spectrums. The gain horns are also orthogonally positioned relative to each other.

Figure 4:
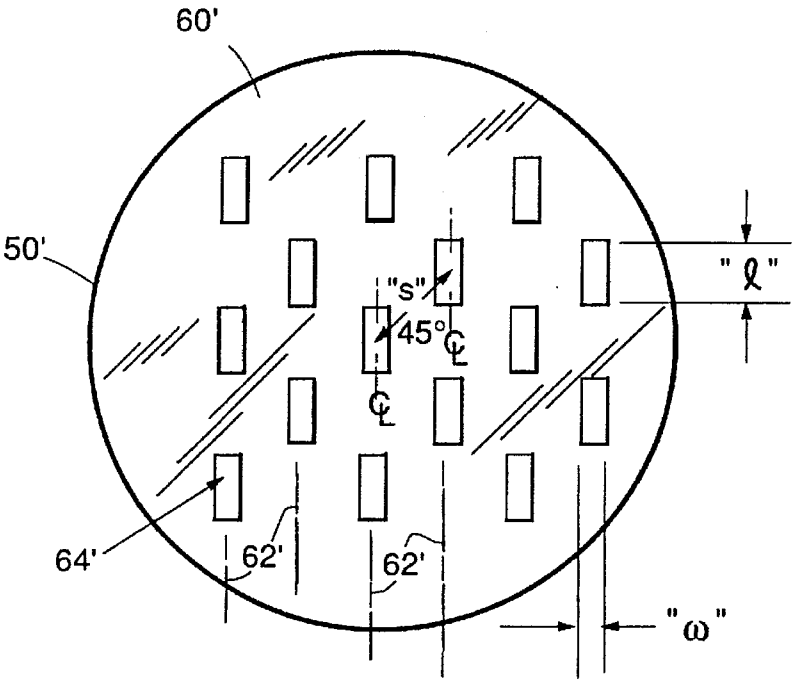
FIG. 4 is a front view of the radome structure of FIG. 3.

FIG. 4 is a front view of the flat radome panel 50', illustrating the configuration of the grid 60' in further detail. In this exemplary embodiment, the grid elements 64' have a length "1"=0.413 wavelength at $F_{low}$, the center frequency of the lower frequency band (X band in this example), and a width dimension "w"=0.046 wavelength at $F_{low}$. The monopole elements in each row are staggered relative to corresponding elements in adjacent rows. As shown in FIG. 4, the distance "S" on diagonal between these corresponding staggered elements i=0.446 wavelength at $F_{low}$. These dimensions are typical for a planar radome surface. These dimensions would change somewhat for a hemispherical or ogival-shaped radome surface. The design of the grid elements and spacing for a curved surface, e.g., a radome ogival surface, is a function of the angle of incidence of the incident radiation and will vary somewhat over the radome surface, i.e., from nose to attachment ring.

The flat dielectric radome 50' shown in FIGS. 3 and 4 exhibits μ/2 thickness, optimal for RF transmittance for horizontally polarized signals at $F_{high}$. The dielectric sheet and the dichroic monopole grid 60' produce an effective μ/2 thickness for vertically polarized RF energy at $F_{low}$.

Figure 5:
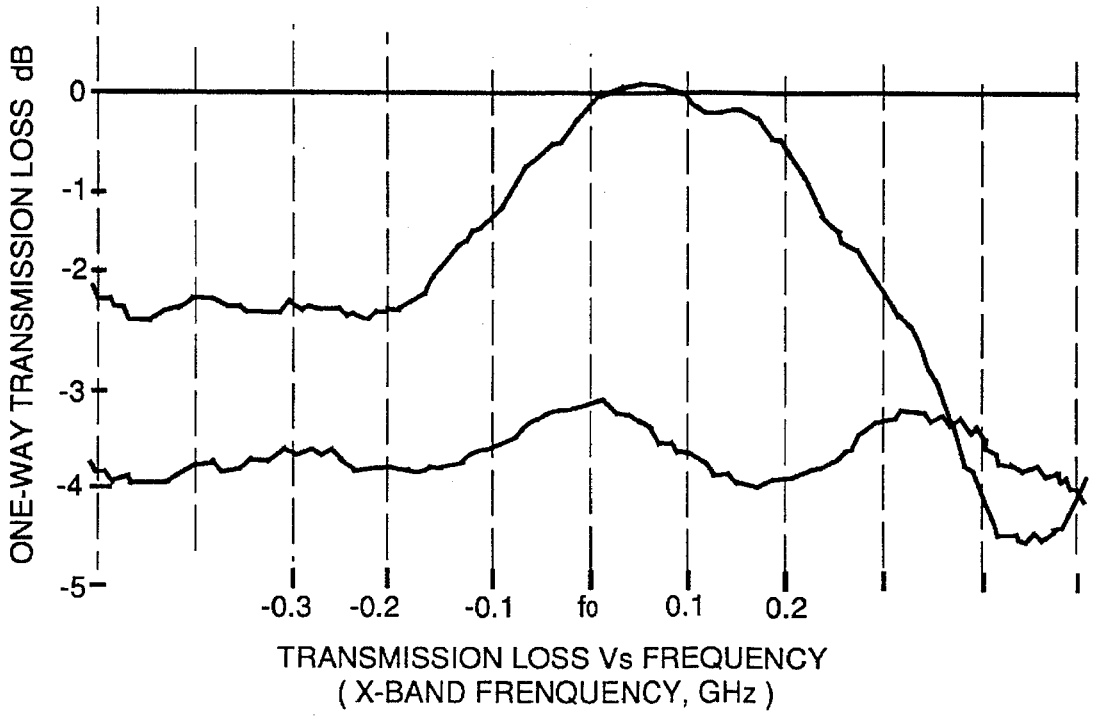
FIGS. 5 and 6 are graphs illustrating exemplary test results for the test configuration of FIG. 3.
Figure 6:
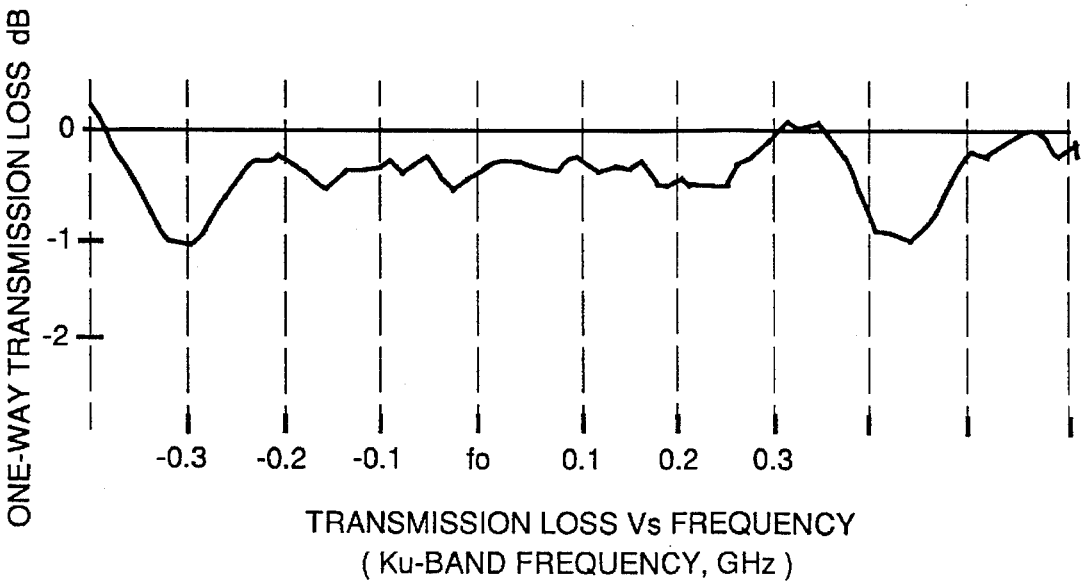

One-way transmission loss measurements were performed looking through this high dielectric panel 50'. FIG. 5 illustrates insertion loss versus frequency at X band ($F_{low}$) to be −3 to −4 dB without the grid, whereas the losses at Ku-band ($F_{high}$) are less than ½ dB. With the dielectric adjustment grid 60' applied to the Ku-band-tuned alumina surface 50', the X-band transmission loss is reduced to one dB, or less, over a greater than 3% frequency range. For this configuration, the measured losses at Ku-band remain below ½ dB over a 4% frequency band as illustrated in FIG. 6.

The flat alumina panel 50' representing the radome is a non-ideal configuration. A full hemisphere, or (to a lesser extent) an ogival-shaped structure, would improve the quiet zone in the sensor environment, i.e., the volumetric region in close proximity to the antenna inside the radome. The consequence of employing this orthogonally polarized resonant grid technique would be dual frequency radome performance with bandwidth parameters of one-way transmission loss of <1.0 dB, boresight error slope <0.03 deg/deg and sidelobe level degradation of <1.0 dB.

Figure 7:
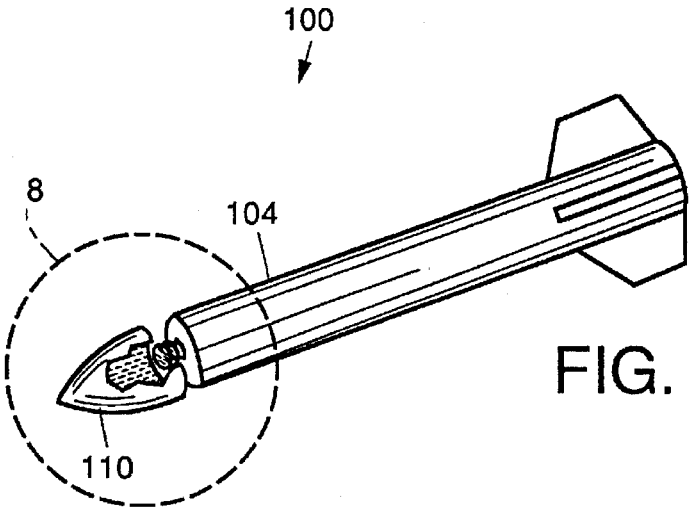
FIG. 7 is an isometric view of a missile including a dual band radome and antenna structure in accordance with the invention.
Figure 8:
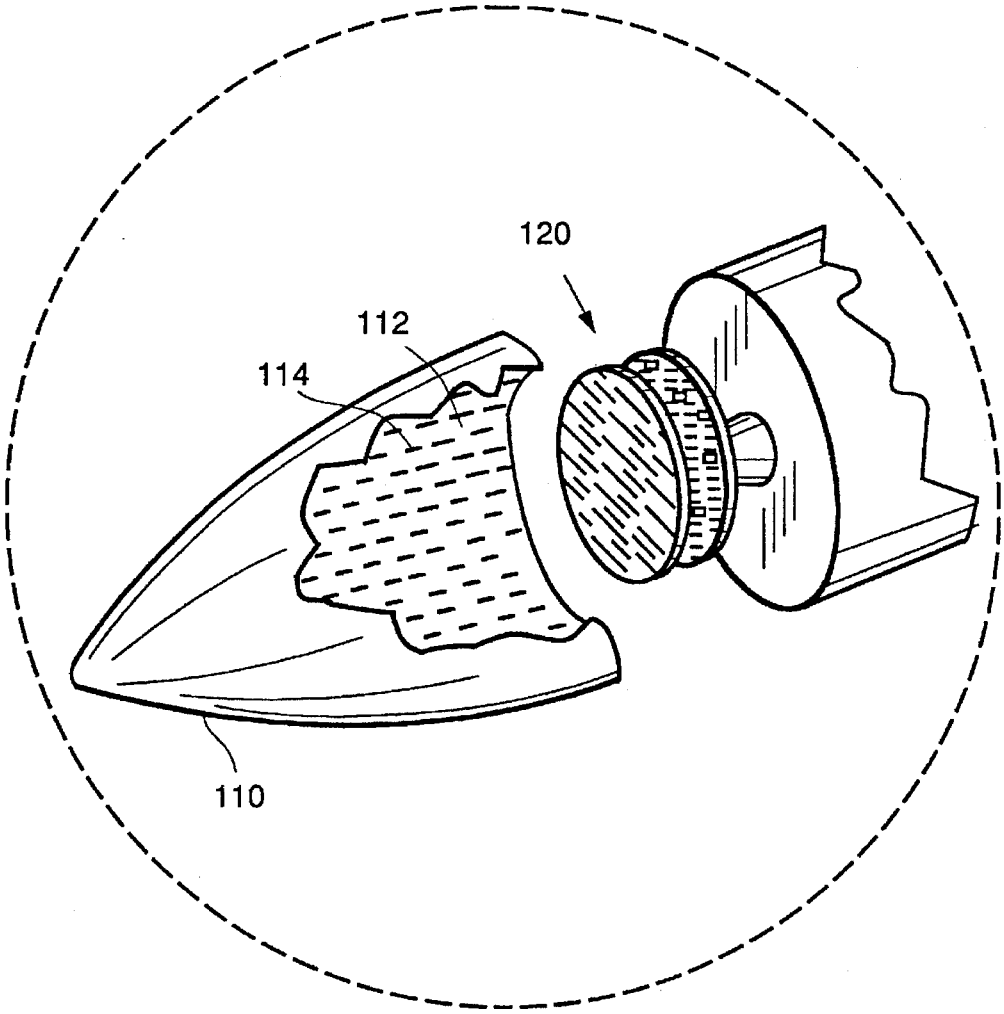
FIG. 8 is an exploded view of the nose of the missile of FIG. 7, showing the radome removed from the missile body to expose the dual band antenna array, and with the radome partially broken away to show the monopole grid applied to the inner surface of the radome.

FIG. 7 is an isometric view of a missile 100 including a dual band radome and antenna structure in accordance with the invention. FIG. 8 is an exploded view of the nose of the missile of FIG. 7, showing the radome 110 removed from the missile body 104 to expose the dual band antenna array 120. The radome 110 is partially broken away to show the monopole grid 114 applied to the inner surface 112 of the radome. The grid 114 could alternatively be applied to the outer surface of the radome, or embedded within the dielectric wall of the radome. The radome wall has a thickness equal to one-half wavelength at a frequency in the higher frequency band, e.g., Ku band. The grid 114 is tuned for resonance at a frequency in the low frequency band, e.g., X band.

Figure 9:
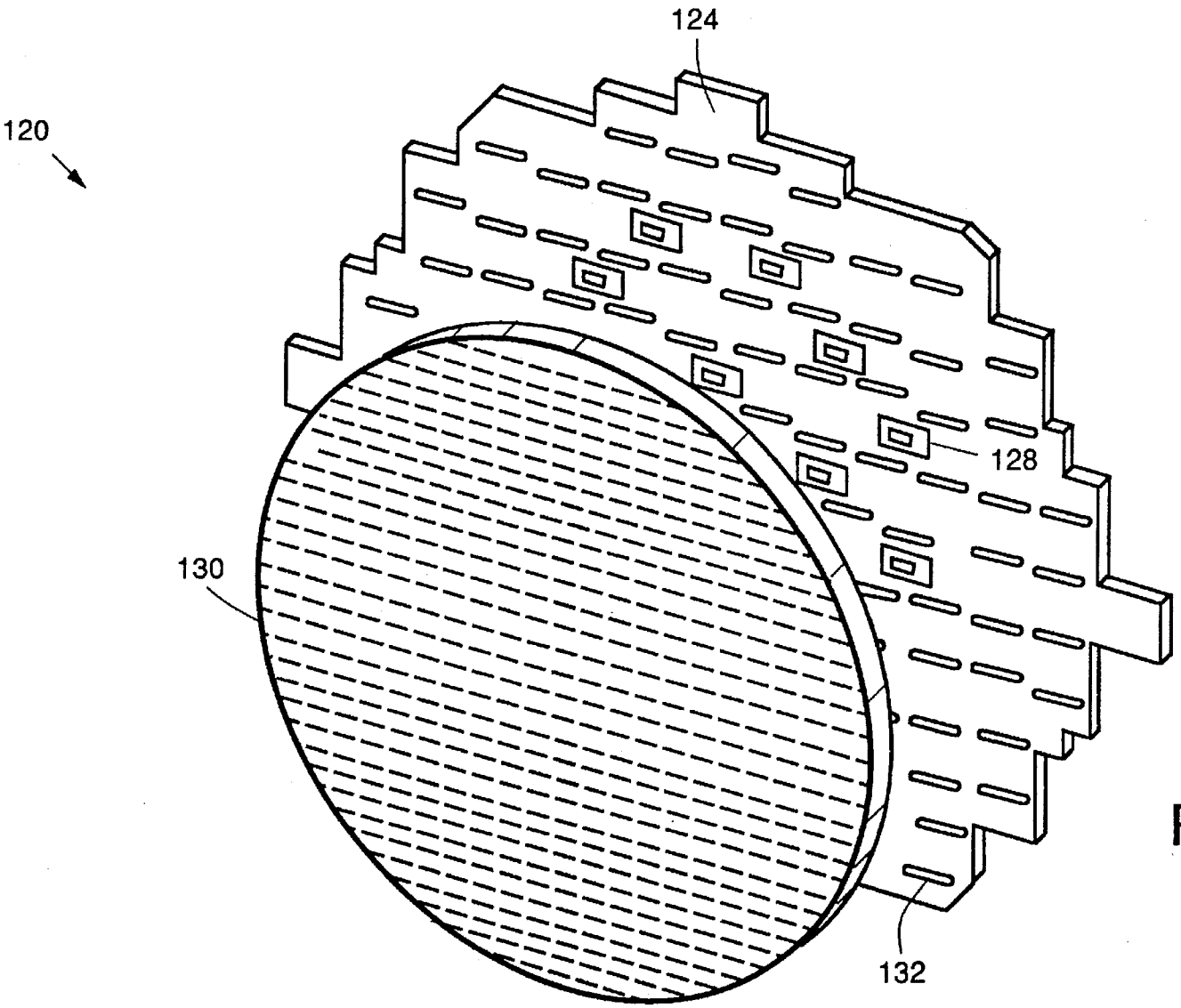
FIG. 9 is a perspective view of the exemplary dual band antenna array of the missile of FIG. 7.

FIG. 9 is a perspective view of the exemplary dual band antenna array 120 of the missile of FIG. 7. The array 120 includes a vertically polarized X band slotted planar array 124 and an array of horizontally polarized patch-excited image array radiators 128 operable at Ku band. A frequency selective surface (FSS) dichroic image plate 130 comprises a honeycomb backing plate structural member 132 on which is formed the FSS comprising a plurality of metallic monopole strips. The image plate 130 is supported above the antenna array 120 by standoffs to improve the array performance, in the manner described in commonly assigned U.S. Pat. No. 5,394,163.

The particular dual band antenna array shown in FIG. 9 is only intended as an example of one type of dual band antenna array which can be used with the radome structure. Other dual band antennas suitable for the purpose include planar/slotted arrays, horn antennas, patch antennas, flared notch antennas, dipole antennas and annular patch antennas. Also, a dual band system can likewise be formed from combining type of antenna with another type, e.g., a planar array with a dipole.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A dual frequency radome for protecting an antenna from the environment, the radome tuned for efficient transmittance of electromagnetic radiation at a first frequency band and polarized at a first polarization sense and of radiation at a second frequency band and polarized at a second polarization sense which is transverse to said first polarization sense, the radome comprising a dielectric wall having a thickness to tune said radome for efficient operation at said first frequency band, said thickness equal to one-half wavelength at a frequency in said first frequency band, said radome further including apparatus for tuning said radome to efficient operation at said second frequency band without substantially impairing operation of said radome at said first frequency band, said tuning apparatus consisting essentially of a grid of dichroic monopole elements supported by said dielectric wall, said grid consisting essentially of monopole elements arranged in a plurality of parallel rows, said rows generally aligned with said second polarization sense, said monopole elements and said dielectric wall cooperating to form a polarization-sensitive resonate reflector structure resonant at a frequency within said second frequency band and which responds to co-polarized RF energy of said second polarization sense while generally insensitive to RF energy of said first polarization sense, said monopole elements orthogonal to said first polarization sense and adapted to tune said radome to efficient operation at said second frequency band.

2. The radome of claim 1 wherein said first and second frequency bands have a non-harmonic relationship.

3. The radome of claim 1 wherein said monopole elements comprise a conductor pattern formed on a surface of said radome.

4. The radome of claim 1 wherein said grid of monopole elements comprises a plurality of rows of said elements, and wherein elements in each row are staggered relative to corresponding elements in adjacent rows.

5. The radome of claim 1 wherein said dielectric wall has a hemispherical shape.

6. The radome of claim 1 wherein said dielectric wall has an ogival shape.

7. A dual frequency antenna and radome system, comprising:

a dual frequency antenna system for operation at a first, higher frequency RF band and at a second lower frequency RF band, said antenna system including a first antenna operable at said first frequency band and a second antenna operable at said second frequency band, and wherein said first and second antennas are orthogonally polarized; and a radome for protecting the antenna system from the environment, said radome tuned for dual frequency band operation, said radome comprising a dielectric wall having a thickness to tune said radome for efficient operation at said first frequency band, said thickness equal to one-half wavelength at a frequency in said first frequency band, said radome further including apparatus for tuning said radome to efficient operation at said second frequency band without substantially impairing operation of said radome at said first frequency band, said tuning apparatus consisting essentially of said dielectric wall and a grid of dichroic monopole elements supported by said dielectric wall, said grid consisting essentially of monopole elements arranged in a plurality of parallel rows, said rows generally aligned with said second polarization sense, said monopole elements and said dielectric wall cooperating to form a polarization-sensitive resonate reflector structure resonant at a frequency within said second frequency band and which responds to co-polarized RF energy of said second polarization sense while generally insensitive to RF energy of said first polarization sense, said monopole elements orthogonal to said first antenna and adapted to tune said radome to efficient operation at said second frequency band.

8. The system of claim 7 wherein said first and second frequency bands have a non-harmonic relationship.

9. The system of claim 7 wherein said monopole elements comprise a conductor pattern formed on a surface of said radome.

10. The system of claim 7 wherein said grid of monopole elements comprises a plurality of rows of said elements, and wherein elements in each row are staggered relative to corresponding elements in adjacent rows.

11. The system of claim 7 wherein said dielectric wall of said radome has a hemispherical shape.

12. The system of claim 7 wherein said dielectric wall of said radome has an ogival shape.

13. A missile with a dual frequency antenna and radome system, comprising:

an aerodynamic missile body;

a dual frequency antenna system secured within said missile body for operation at a first, higher frequency RF band and at a second lower frequency RF band, said antenna system including a first antenna operable at said first frequency band and a second antenna operable at said second frequency band, and wherein said first and second antennas are orthogonally polarized; and a missile radome for protecting said antenna system from the environment, said radome tuned for dual frequency operation and connected to said missile body to enclose an aperture of said antenna system, said radome comprising a dielectric wall having a thickness to tune said radome for efficient operation at said first frequency band, said thickness equal to one-half wavelength at a frequency in said first frequency band, said radome further including apparatus for tuning said radome to efficient operation at said second frequency band without substantially impairing operation of said radome at said first frequency band, said tuning apparatus consisting essentially of a grid of dichroic monopole elements supported by said dielectric wall, said grid consisting essentially of monopole elements arranged in a plurality of parallel rows, said rows generally aligned with said second polarization sense, said monopole elements and said dielectric wall cooperating to form a polarization-sensitive resonate reflector structure resonant at a frequency within said second frequency band and which responds to co-polarized RF energy of said second polarization sense while generally insensitive to RF energy of said first polarization sense, said monopole elements orthogonal to said first antenna and adapted to tune said radome to efficient operation at said second frequency band.

14. The missile of claim 13 wherein said first and second frequency bands have a non-harmonic relationship.

15. The missile of claim 13 wherein said monopole elements comprise a conductor pattern formed on a surface of said radome.

16. The missile of claim 15 wherein said grid of monopole elements comprises a plurality of rows of said elements, and wherein elements in each row are staggered relative to corresponding elements in adjacent rows.

17. The missile of claim 13 wherein said dielectric wall of said radome has a hemispherical shape.

18. The missile of claim 13 wherein said dielectric wall of said radome has an ogival shape.

* * * * *